US006214087B1

(12) United States Patent
Hoffman et al.

(10) Patent No.: US 6,214,087 B1
(45) Date of Patent: Apr. 10, 2001

(54) TREATMENT OF IRON OXIDE AGGLOMERATES BEFORE INTRODUCTION INTO FURNACE

(75) Inventors: Glenn E. Hoffman, Lancaster, SC (US); David C. Meissner; Kyle J. Shoop, both of Charlotte, NC (US)

(73) Assignee: Midrex International B.V. Rotterdam, Zurich Branch, Zurich (CH)

( * ) Notice: Subject to any disclaimer, the term of this patent is extended or adjusted under 35 U.S.C. 154(b) by 0 days.

(21) Appl. No.: 09/272,276

(22) Filed: Mar. 19, 1999

(51) Int. Cl.[7] ..... C21B 13/08

(52) U.S. Cl. ..... 75/500; 75/321; 75/484; 75/504; 75/414; 75/629; 75/641

(58) Field of Search ..... 75/504, 321, 484, 75/500, 320, 414, 641, 629

(56) References Cited

U.S. PATENT DOCUMENTS 2,869,850 * 1/1959 Wienert ..... 75/321
3,443,931 * 5/1969 Beggs et al. ..... 75/484

* cited by examiner

*Primary Examiner*—Melvyn Andrews
(74) *Attorney, Agent, or Firm*—Dougherty & Clements LLP

(57) ABSTRACT

A method for producing solid metal product is disclosed including the steps of providing carbon and metal bearing compounds in compacts, coating the compacts with treatment materials, encapsulating the compacts with carbonaceous containing materials to form a residual layer, and treating the residual layer before introduction of the compacts into a furnace. The compacts contain carbon containing metal bearing compounds, and are coated with mixtures of carbonaceous materials dispersed within a binder material such as a viscous liquid, molasses, alcohol, or fuel oil. The coated compacts are treated to form a hardened outer residual layer. The outer residual layer provides for a sacrificial outer coating on the compacts that reacts with any oxidizing gaseous components within the furnace, while the carbon containing metal bearing compounds within the compacts are heated and metallized inside the compounds. The outer residual layer provides for improved production of higher purity of metal and carbon nuggets with decreased furnace processing times. Therefore, an increase in purity of the metal product is produced at a lower cost, with minimization of the interaction of the molten metal and slag from nuggets with the furnace hearth surface.

18 Claims, 2 Drawing Sheets

TREATMENT OF IRON OXIDE AGGLOMERATES BEFORE INTRODUCTION INTO FURNACE

FIELD OF INVENTION

This invention relates to a method for treatment of feed material before feeding into an ore processing furnace. More particularly, this invention relates to the encapsulation of iron bearing agglomerates with carbonaceous materials before introduction into a furnace for improvements in iron oxide metallization.

BACKGROUND OF THE INVENTION

In 1998, Midrex International received U.S. Pat. No. 5,730,775, that teaches an improved method (known by the service mark of FASTMET7) and apparatus for producing direct reduced iron from dry iron oxide and carbon compacts that are placed onto a rotary hearth, and are metallized by heating the compacts for a short time period. For a general understanding of the recent art, U.S. Pat. No. 5,730,775 is herein incorporated by reference.

Improvements in efficiency have been attempted within the industry with furnace modifications that provide a vitreous hearth layer that remains vitrified at increased temperatures, with a modification that provides an additional hearth coating to allow for shortened processing time of iron oxide compacts. Coating of the hearth surface facilitates product removal, reduces loss of purified molten iron onto the vitreous hearth layer and/or reduces loss on the interior surfaces of furnaces from the protective coating of surfaces with metallized iron oxides during processing and reducing operations. The above described hearth coatings add additional costs by adding materials onto the hearth layers, add to the complexity of reactions occurring within the furnace, and add additional processing time for the hearth coatings to cure onto the hearth surfaces.

Improvements are sought within the metal production industry for treatment with coatings of carbonaceous feed material before placement within a furnace, the coatings providing improved metallization of compounds within the furnace without additional treatment and coatings on the furnace hearth surface, or in conjunction with limited hearth surface conditioning.

SUMMARY OF THE INVENTION

The invented process includes the method of producing solid metal product by treating carbon containing metal bearing compounds in compacts or agglomerates with coatings of treatment material before feeding compacts or agglomerates into a furnace. The method of producing includes the steps of providing carbon containing metal bearing compounds in compacts, coating the metal bearing compounds in compacts with a treatment material encapsulating the metal bearing compounds in compacts, treating the treatment material to form a hardened encapsulating coating on the compacts, feeding the compacts into a furnace, heating and reducing the metal bearing compounds in the compacts, forming liquid metal and carbon globules and slag particulates, cooling and creating solid metal and carbon nuggets, and removing solid metal and carbon nuggets and slag particulates from the furnace.

OBJECTS OF THE INVENTION

The principal object of the present invention is to provide a more efficient method of achieving reduction of metal bearing compounds in compacts and production of metal nuggets at elevated temperatures in a reducing furnace.

An additional object of the present invention is to provide a method for pre-treatment of carbon containing metal bearing compounds in compacts, forming hardened outer surface coatings around the compacts to reduce the generation of particulates when the compacts are fed into a furnace.

A further object of the present invention is to form a sacrificial layer of treatment material onto carbon containing metal bearing compounds in compacts, to provide a sacrificial layer to react with oxidizing combustion components within a furnace.

An additional object of the present invention is to provide a coating on carbon containing iron bearing compounds in compacts or agglomerates that prevents interaction between the molten iron and slag in the compacts or agglomerates with the hearth surface of the furnace.

The objects of the invention are met by a method of producing carbon containing metal bearing compounds comprising the steps of providing a plurality of compacts having carbon containing metal bearing compounds, coating the compacts with a treatment material, encapsulating the exterior surfaces of the compacts with a residual layer, and treating the residual layer on the coated compacts. After the encapsulating coating is in place, the compacts are feed into a furnace, heating and reducing the carbon containing metal bearing compounds within the compacts without the degradation of the compacts, forming metal and carbon globules and slag particulates, cooling of the liquid metal and carbon globules, and creating of solid metal and carbon nuggets which remain separate from the furnace hearth surface for ease of removal of the solid metal and carbon nuggets and slag particulates from the furnace.

BRIEF DESCRIPTION OF THE DRAWINGS

The foregoing and other objects will become more readily apparent by referring to the following detailed description and the appended drawings in which.

DESCRIPTION OF PREFERRED EMBODIMENTS

Figure 1:
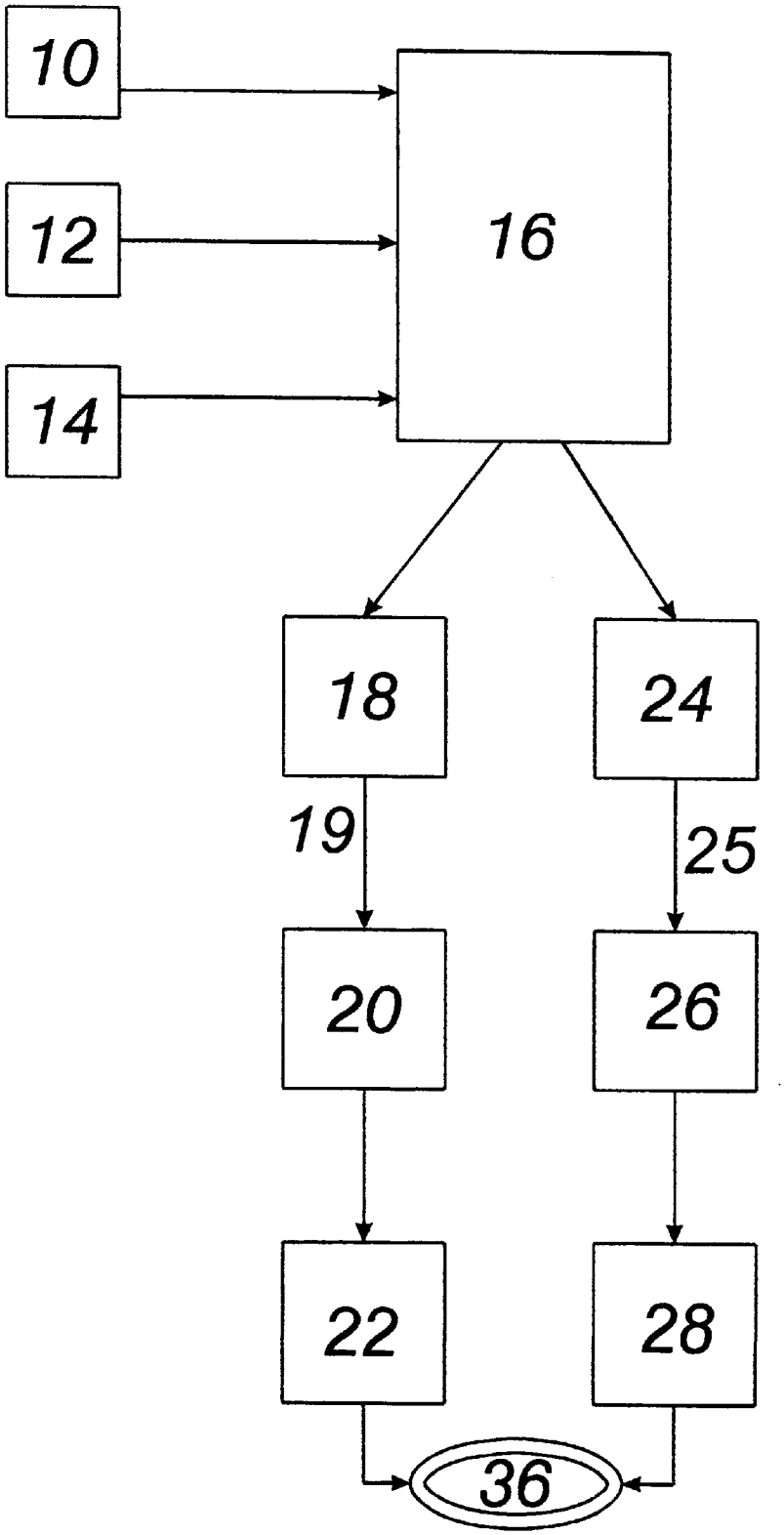
FIG. 1 is a flow diagram of the invented method of producing solid metal product by treatment of compacts and agglomerates.
Figure 2:
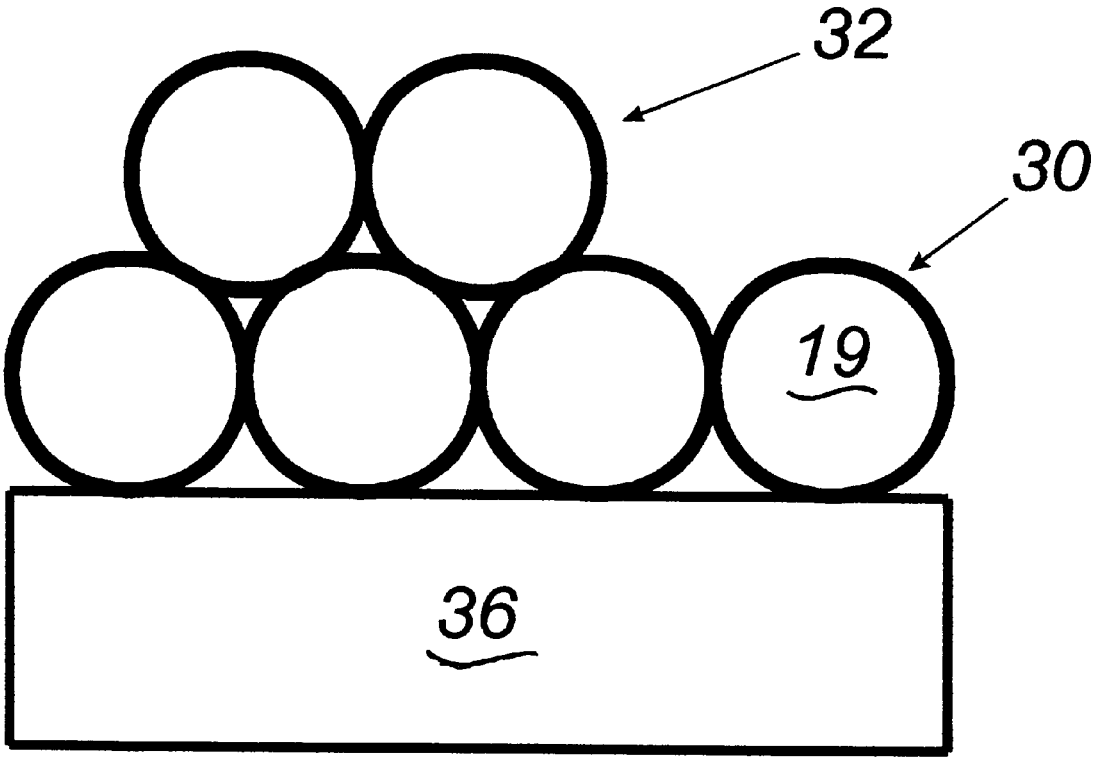
FIG. 2 is a side view of the coated compacts placed onto a furnace hearth for heating and reducing of carbon containing metal bearing compounds within the compacts.

Referring to the drawings, and more particularly to FIG. 1, the method of producing solid metal product from carbon containing metal bearing compounds before feeding the compounds into a furnace comprises the following method steps, specifically providing iron oxide compounds 10, providing reductants such as coal or pet coke particulates or powder 12, and providing binder materials 14, into a mixer 16 that is commonly known in the metals preparation and production industry. After sufficient mixing of raw materials, the mixer 16 generates a generally dry material containing carbon and iron oxide compounds, and binder that is fed to: (a) a pelletizer machine 18 to which sufficient liquid is added so as to produce pelletized wet greenball compacts 19, or (b) a briquetting machine 24 to produce carbon and iron oxide compounds in briquette agglomerates 25.

The wet greenball compacts 19 or the briquette agglomerates 25 are treated by coating steps 20, 26. The coating steps 20, 26 may include spraying the wet compacts 19 with molasses or carbonaceous materials dispersed in a coating binder of molasses, alcohol or fuel oil, or other carbon containing liquid. The carbonaceous materials may include pulverized coal, coal fines, graphite fines, waste materials from prior furnace operations, or pet coke, or similar carbon containing particulate materials. The coating of carbonaceous materials may be considered a finishing step after wet greenball compacts 19 or briquette agglomerates 25 are formed.

One type of coating utilized for the coating and encapsulating steps may be molasses having particulate carbonaceous materials dispersed in the viscous liquid. The liquid mixture encapsulates the greenball compacts 19, leaving a residual layer 30 around each compact 19. The residual layer 30 may be dried by air drying or heating 22, 28, to provide an hardened encapsulating coating on either the greenball compacts 19, or the briquette agglomerates 25.

A variation of the above described method steps for briquette agglomerates 25 is that the encapsulating residual layer 30 may be sprayed on the briquettes 25 in the coating step 26, using molasses and carbonaceous materials, but the residual layer 30 may not be required to dry in the drying step 28 before the briquettes with residual layer 30 are fed to a rotary hearth furnace 36 (RHF).

A primary benefit of. treating iron bearing compacts and briquettes to form residual carbon layers on the surface of coated compacts is that it minimizes and provides protection against solution loss of interior carbon as well as re-oxidation of metallized iron product when the compacts and briquettes are heated in a furnace such as a rotary hearth furnace 36 (RHF). Tests have shown that further heating treated compacts result in melting the reducing iron into an iron nugget in less time and with increased iron yield. Also cost and processing advantages to coating the surface of compacts and briquettes with molasses and carbonaceous materials, as compared to a recently developed technique of placing numerous coating layers of carbon compounds onto the hearth surface of a RHF. Coating of compacts and briquettes occur prior to introduction of compacts and briquettes into a furnace, with the coating, encapsulating, and treating steps of this invention not requiring high temperatures for drying and hardening the outer coating layers.

There is an additional benefit that the pre-treated, coated compacts and briquettes provide improved protection against interaction between molten iron or liquid slag with the RHF hearth surface. Treated green compacts also result in less generation of fines and hence deposition on the hearth surface due to mechanical degredation of the processing during physical transfer steps prior to introduction onto the hearth surface. The coated and treated compacts and briquettes allow formation of highly metallized iron beneath the coated layer within each compact structure with molten iron separating from gangue materials, for cooling and removal from the furnace. The invented method of coating, encapsulating, and treating metal oxide feed materials may be applied to metal production industries such as the copper, nickel, and similar industries.

ALTERNATIVE EMBODIMENTS

The carbonaceous coatings may consist of coal fines, graphite fines, or other carbon containing materials that may be mixed with a semi-liquid carrier such as molasses, alcohol or a fuel oil liquid. The treatment material may be poured over, sprayed onto, or coated by mechanical application such as rolling of the spherical compacts or similar shaped agglomerates within the treatment material for dispersion of the treatment material across the circumference of the agglomerates. The treatment material may also be applied to briquetted agglomerates of carbon and iron oxide compounds by spraying or dipping of the briquettes into the treatment material. The coatings of treatment material may not need to be dried completely before the carbon and iron oxide containing briquetted agglomerates are introduced into a furnace. The viscosity of the carrier of the treatment material, specifically the water content of the treatment material such as molasses, will determine whether the briquettes or agglomerate materials are dried. Use of a carrier material of higher viscosity for encapsulating the briquetted agglomerates or compacts may negate the need for extensive drying the briquettes or compacts before processing within a furnace.

The coated greenball compacts 19, or briquetted agglomerates 25 may be stacked in multiple layers 32 or single layers without significant damage to the residual layer 30 coating, for feeding into a metal oxide heating and reduction furnace (not shown).

The step of feeding of the coated compacts 19 or the coated briquettes 25 onto the hearth surface of a rotary hearth furnace (RHF) may be accomplished by any transfer method known in the art, such as screw conveyor or belt conveyor. Heating the coated metal bearing compacts 19 in the rotating hearth surface of the RHF provides the residence time and temperatures to adequately reduce the metal bearing compounds within the compacts or agglomerates, to form liquid carbon and iron bearing globules and slag particulates. The globules and slag particulates may be cooled within the furnace by techniques commonly known in the industry, forming solid metal and carbon nuggets. The solid metal and carbon nuggets and slag particulates may be removed from the furnace and delivered to other furnaces for additional processing.

SUMMARY OF THE ACHIEVEMENT OF THE OBJECTS OF THE INVENTION

From the foregoing, it is readily apparent that we have invented a method of treatment of carbon containing iron bearing compacts 19 and agglomerates with encapsulating carbon containing materials which allow for decreasing the heat processing times within a furnace, and for producing higher quality metallized iron product after heat treatment within a furnace. The pretreatment of carbon containing iron bearing compounds within compacts 19 of agglomerate material with hardened carbonaceous coatings, before the compacts 19 are fed into the furnace, provides for a sacrificial outer coating that reacts with any oxidizing gaseous components within the furnace, while the interior of the compacts of agglomerate carbon and iron bearing compounds are heated.

The invention has been described in detail, with reference to certain preferred embodiments, in order to enable the reader to practice the invention without undue experimentation. It is to be understood that the foregoing description and specific embodiments are merely illustrative of the best modes of the invention and the principles thereof, and that various modifications and additions may be made to the methods by those skilled in the art, without departing from the spirit and scope of the appended claims.

What is claimed is:

1. A method for producing solid metal product from carbon containing metal bearing compounds, comprising the steps of:

(a) providing a plurality of compacts containing carbon and metal bearing compounds;

(b) coating said compacts with a treatment material;

(c) encapsulating the exterior surfaces of said coated compacts with a residual layer;

(d) treating said residual layer on said coated compacts before feeding said coated compacts onto the hearth of a furnace;

(e) feeding said coated compacts having said residual layer into said furnace;

(f) heating said coated compacts;

(g) reducing said coated compacts;

(h) forming liquid metal and carbon globules and slag particulates;

(i) cooling said liquid metal and carbon globules, creating solid metal and carbon nuggets; and (j) removing solid metal and carbon nuggets and slag particulates within said coated compacts from said furnace.

2. The method of claim 1, wherein the providing step further comprises providing compacts containing agglomerates of metal bearing compounds, carbon compounds, and a binder.

3. The method of claim 2, wherein the coating step further comprises coating said compacts or said agglomerates with a coating binder selected from the group consisting of coal fines, graphite fines, pulverized coal, pet coke, molasses, alcohol, oil, or a combination of these materials, with other carbonaceous materials.

4. The method of claim 3, wherein the coating step further comprises applying said coating binder on said compacts or compacts by dipping, rolling, spraying, or dispersing said coating binder over all surfaces of said compacts or said agglomerates.

5. The method of claim 4, wherein the treating step further comprises treating said coating binder by drying, forming a hardened residual layer of carbonaceous materials around said compacts or said agglomerates.

6. The method of claim 4, wherein the treating step further comprises treating said coating binder by heating, forming a hardened residual layer of carbonaceous materials around said compacts or said agglomerates.

7. A method for producing solid iron product from carbon containing iron bearing compounds comprising the steps of:

(a) providing a plurality of compacts containing carbon and iron bearing compounds;

(b) coating said compacts with a treatment material;

(c) encapsulating the exterior surfaces of said coated compacts with a residual layer;

(d) treating said residual layer on said coated compacts before feeding said coated compacts into a furnace;

(e) feeding said coated compacts having said residual layer into said furnace;

(f) heating said coated compacts;

(g) reducing said coated compacts;

(h) forming liquid iron and carbon globules and slag particulates within said coated compacts;

(i) cooling said liquid iron and carbon globules, creating solid iron and carbon nuggets; and (j) removing solid iron and carbon nuggets and slag particulates from said furnace.

8. The method of claim 7, wherein the providing step further comprises providing compacts containing agglomerates of iron bearing compounds, carbon compounds, and a binder.

9. The method of claim 8, wherein the coating step further comprises coating said compacts or said agglomerates with a coating binder selected from the group consisting of coal fines, graphite fines, pulverized coal, pet coke, molasses, alcohol, oil, or a combination of these compounds or other carbonaceous materials.

10. The method of claim 9, wherein the coating step further comprises applying said coating binder on said compacts or compacts by dipping, spraying, rolling, or dispersing said coating binder over all surfaces of said compacts or said agglomerates.

11. The method of claim 10, wherein the treating step further comprises treating said coating binder by drying, forming a hardened residual layer of carbonaceous materials around said compacts or said agglomerates.

12. The method of claim 10, wherein the treating step further comprises treating said coating binder by heating, forming a hardened residual layer of carbonaceous materials around said compacts or said agglomerates.

13. A method for producing solid iron product from carbon containing iron bearing compounds with coating mixtures containing carbon compounds, comprising the steps of:

(a) providing a plurality of compacts containing carbon and iron bearing compounds;

(b) coating said compacts with a treatment material;

(c) encapsulating the exterior surfaces of said coated compacts with a residual layer;

(d) treating said residual layer on said coated compacts before feeding said coated compacts into a rotary hearth furnace;

(e) feeding said coated compacts having said residual layer into said rotary hearth furnace;

(f) heating said coated compacts;

(g) reducing said coated compacts;

(h) forming liquid iron and carbon globules and slag particulates within said coated compacts;

(i) cooling said liquid iron and carbon globules creating solid iron and carbon nuggets; and (j) removing solid iron and carbon nuggets and slag particulates from said rotary hearth furnace.

14. The method of claim 13, wherein the providing step further comprises providing compacts containing agglomerates of iron bearing compounds, carbon compounds, and a binder.

15. The method of claim 14, wherein the coating step further comprises coating said compacts or said agglomerates with a coating binder selected from the group consisting of coal fines, graphite fines, pulverized coal, pet coke, molasses, alcohol, oil, or a combination of these materials with other carbonaceous materials.

16. The method of claim 15, wherein the coating step further comprises applying said coating binder on said compacts or said agglomerates by dipping, rolling, spraying, or dispersing said coating binder over all surfaces of said compacts or said agglomerates.

17. The method of claim 16, wherein the treating step further comprises treating said coating binder by drying, forming a hardened residual layer of carbonaceous materials around said compacts or said agglomerates.

18. The method of claim 17, wherein the treating step further comprises treating said coating binder by heating, forming a hardened residual layer of carbonaceous materials around said compacts or said agglomerates.

* * * * *